US005686880A

United States Patent [19]

Cummins et al.

[11] Patent Number: 5,686,880

[45] Date of Patent: Nov. 11, 1997

[54] CONTINUOUS WEAVE RESISTOR GRID

[75] Inventors: Robert Cummins, Coraopolis, Pa.; Victor V. Kirilloff, Lincoln, Nebr.; William A. Benson, Pittsburgh, Pa.

[73] Assignee: Mosebach Manufacturing Company, Pittsburgh, Pa.

[21] Appl. No.: 561,299

[22] Filed: Nov. 21, 1995

[51] Int. Cl.[6] ..... H01C 10/16

[52] U.S. Cl. ..... 338/316; 338/280; 338/283; 338/289; 338/319

[58] Field of Search ..... 338/58, 279–281, 338/283, 284, 315–319; 219/532

[56] References Cited

U.S. PATENT DOCUMENTS

| | | | |
|---|---|---|---|
| 2,721,920 | 10/1955 | Weide | 338/293 |
| 3,697,923 | 10/1972 | Griffes | 338/280 |
| 3,858,149 | 12/1974 | Kirilloff et al. . | |
| 4,051,452 | 9/1977 | Luy | 338/51 |
| 4,100,526 | 7/1978 | Kirilloff et al. . | |
| 4,146,868 | 3/1979 | Kirilloff et al. . | |
| 4,651,124 | 3/1987 | Kirilloff et al. . | |
| 4,651,125 | 3/1987 | Harkness . | |
| 4,837,549 | 6/1989 | Kirilloff et al. . | |
| 4,847,585 | 7/1989 | Kirilloff et al. . | |
| 5,045,831 | 9/1991 | Kirilloff et al. . | |
| 5,049,851 | 9/1991 | Kirilloff et al. . | |
| 5,049,852 | 9/1991 | Cummins et al. . | |
| 5,068,637 | 11/1991 | Bayer . | |
| 5,159,310 | 10/1992 | Cummins et al. . | |
| 5,221,917 | 6/1993 | Cummins . | |
| 5,281,944 | 1/1994 | Kirilloff et al. . | |
| 5,304,978 | 4/1994 | Cummins et al. . | |

*Primary Examiner*—Teresa J. Walberg
*Assistant Examiner*—Karl Easthom
*Attorney, Agent, or Firm*—Paul A. Beck & Associates

[57] ABSTRACT

A resistor grid assembly has a continuous resistor weave with a plurality of generally parallel, plate-like electrical elements. U-shaped bends join two adjacent elements at adjacent ends. The U-shaped bends are located in a bottom group and a top group. There is a top electrical insulating member adjacent the U-shaped bends in the top group and spaced from the U-shaped bends. There is a bottom electrical insulating member adjacent the U-shaped bends in the bottom group. Stop U-shaped pins having a pair of legs with a pair of shoulders are supported by the bottom electrical insulating member. The legs of each stop U-shaped pin extends into a pair of holes in the bottom group of U-shaped pins and rest upon the shoulders which are spaced from the insulator. Wire U-shaped pins are supported by the top electrical insulating member. The wire U-shaped pins have legs inserted into holes in the U-shaped bends in the top group. The U-shaped bends in the top group are spaced from the top insulator. When the resistor elements expand due to heat, the U-shaped bends in the top group move on the legs of the wire U-shaped pin toward the top insulating member. Expansion is controlled in a direction toward the top insulating member and the resistor U-shaped bend slides on the wire U-shaped pin.

8 Claims, 8 Drawing Sheets

CONTINUOUS WEAVE RESISTOR GRID

BACKGROUND OF THE INVENTION

1. Field of the Invention

This invention relates to electrical resistor grid assemblies incorporating a plurality of forced ventilated resistor grids that are used in the dynamic braking or retarding function of large electric motors such as the direct current traction motors on diesel electric locomotives.

During dynamic braking of a diesel electric locomotive, its traction motors operate in a generating mode and supply current to heavy duty resistor grids where the electrical energy is converted to heat and dissipated to the atmosphere with the aid of cooling fans. The resistor elements are formed by generally parallel, plate-like resistor elements with U-shaped bends joining adjacent elements at adjacent ends.

1. Description of the Prior Art

Current conducting elements of the resistor grid are supported in a frame of insulating material having a suitable dielectric, a suitable strength and a sufficiently high thermal rating to withstand the heat produced in the grid.

Typical insulating material for the frame of a resistor grid assembly can have a glass fiber-filled polyester resin which was cured under pressure in a heated mold. This is described in U.S. Pat. No. 5,068,637.

There are practical limits to thermal ratings of the insulating materials. For this reason, it is desirable to minimize the amount of heat that will transfer by conduction, radiation or convection from the heated grid to the frame. It is common practice to space the resistor elements from the insulating frame. The air space along the interior surfaces of the frame will reduce the transfer of heat from the hot resistor elements to the insulating members and will allow these surfaces to be more effectively cooled by the air that is blown by a fan through the resistor elements.

Resistor elements of this type are shown in U.S. Pat. Nos. 5,068,637; 4,651,125; 5,304,978; 5,221,917; 5,281,944; 5,159,310; 5,049,852; 5,045,831; 5,049,851; 4,847,585; 4,837,549; 4,651,124; 4,146,868; 4,100,526; and 3,858,149.

Whenever the resistor elements are heated, the metal will expand. If there is no room for the metal to expand, the metal elements will buckle and touch one another and produce a short circuit. It is helpful to control the resistor element expansion and cooling at both ends of the plate-like parallel resistor elements.

U.S. Pat. No. 5,304,978 shows a technique for allowing the resistor to expand in one direction on a pair of pins 234 in FIG. 50 and described at Column 9 Lines 40–50.

The problem with the above structure is that control of the expansion is not as good because it can be difficult to control the expansion.

SUMMARY OF THE INVENTION

The present invention provides enhanced control of expansion by providing an air gap at both ends at a top and a bottom between the U-shaped bends and insulating members. Also, the support for the U-shaped bends from the insulating member is one piece which makes assembly and manufacture substantially easier and substantially less costly.

To enhance cooling efficiency, where one grid was used, it is now divided into two grids using thinner gage metal which carries one half the current and providing more surface area for cooling at the same total current level. The two grids are placed in electrical parallel connection to achieve this result thereby dividing the total current into two paths which formerly proceeded in one path with heavier gage metal plates.

We provide a resistor grid assembly comprising a continuous resistor weave comprising a plurality of generally parallel, plate-like electrically conductive resistor elements each having two ends and a plurality of U-shaped bends each with a pair of holes, one U-shaped bend joining two adjacent elements at adjacent ends. The U-shaped bends are located in a bottom group and a top group. A top electrical insulating member is adjacent the U-shaped bends in the top group and is spaced a distance from the U-shaped bends in the top group. The spacing is sufficient to allow for expansion of the resistor element when heated in accordance a coefficient of expansion for any particular given metal used. A bottom electrical insulating member is adjacent to the U-shaped bends in the bottom group of U-shaped bends. A plurality of stop U-shaped pins, each having a bottom and two legs and a pair of shoulders and supported by the bottom electrical insulating member at the bottom of the stop U-shaped pin. The legs of each stop U-shaped pin extending upwardly toward the U-shaped bends and inserted into a corresponding pair of holes in the U-shaped bends in the bottom group. The shoulders are spaced from the bottom electrical insulating member. The U-shaped bends in the bottom group rest on the shoulders of the stop U-shaped pins. A plurality of wire U-shaped pins are supported by the top electrical insulating member and each wire U-shaped pin has two legs and a bottom. The legs extend toward the U-shaped bends and are inserted into a corresponding pair of holes in the U-shaped bends in the top group. Whenever the resistor elements heat, expansion is controlled in a direction toward the top insulating member and the resistor U-shaped bend in the top group slides on the wire U-shaped pin.

We provide a second resistor grid assembly substantially similar to the first grid resistor. The first resistor grid assembly is in a first tier and the second resistor grid assembly is in a second tier. The two tiers are connected in electrical parallel.

We provide an electrical tap connecting the first and second tiers. The tap is positioned at some point between the ends of the continuous weave in each of the first and second tiers and extends through the adjacent insulating members of the first and second tiers.

Other details, objects and advantages of this invention will become apparent as the following description of the present preferred embodiment proceeds.

In the accompanying drawings which follow, we have shown a present preferred embodiment of practicing the invention.

DESCRIPTION OF THE FIGURES SHOWN

DESCRIPTION OF THE PREFERRED EMBODIMENTS

Figure 5:
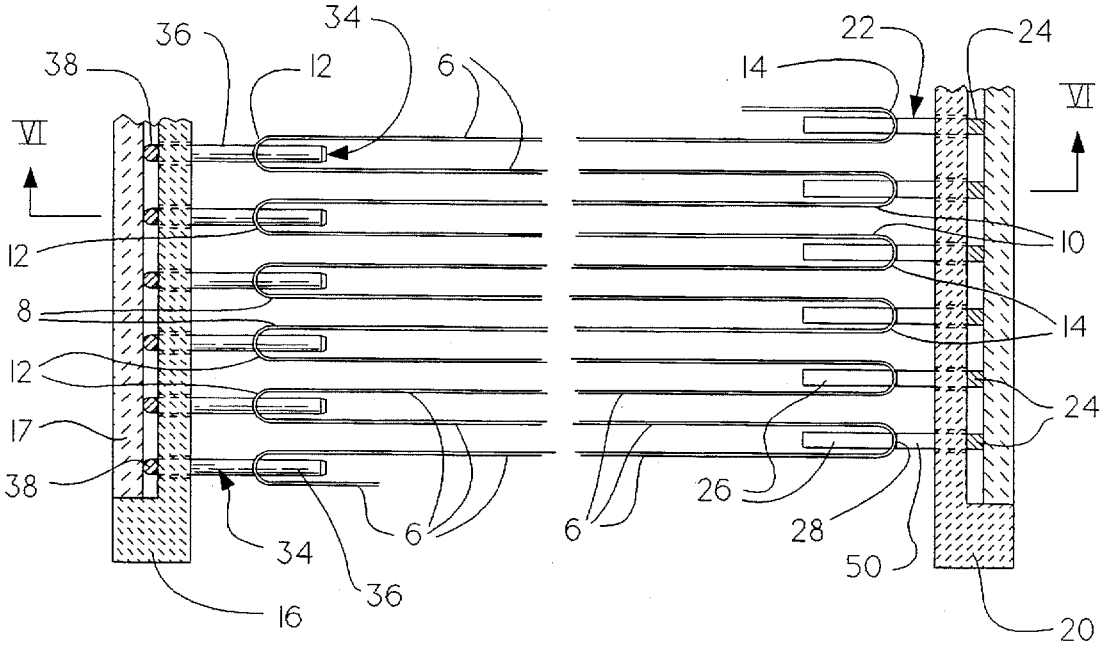
FIG. 5 is a transverse partial sectional view of a fragmentary resistor grid section.
Figure 6:
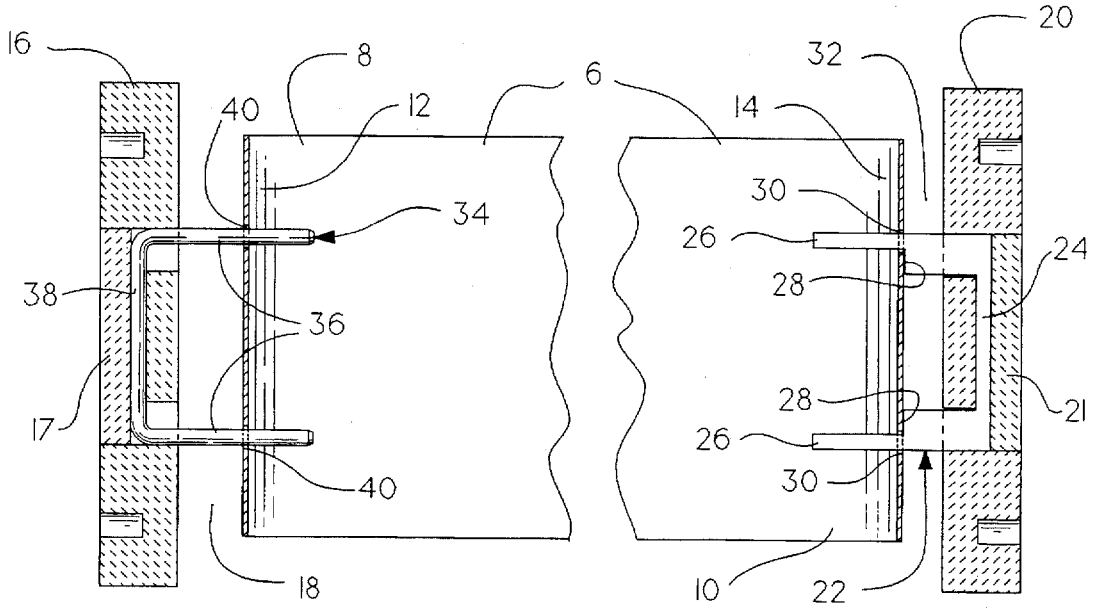
FIG. 6 is a vertical partial sectional view of the resistor section of FIG. 5 taken on the line VI—VI.
Figure 7:
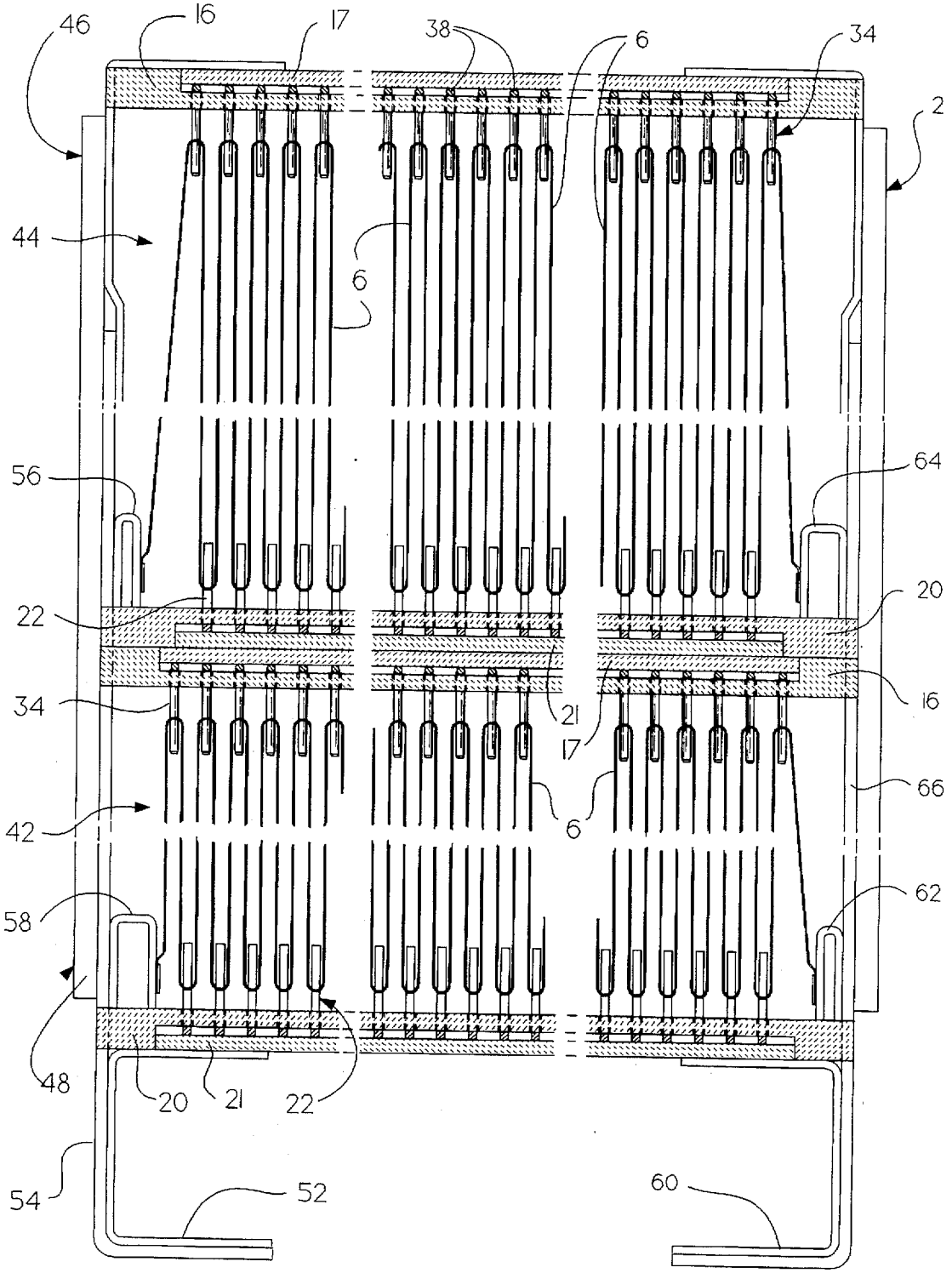
FIG. 7 is a fragmentary front elevational view partially in section of two continuous weave heat dissipating resistor grids, one above the other mounted in their respective frames, one in a top first tier and the other one in a bottom second tier.
Figure 8:
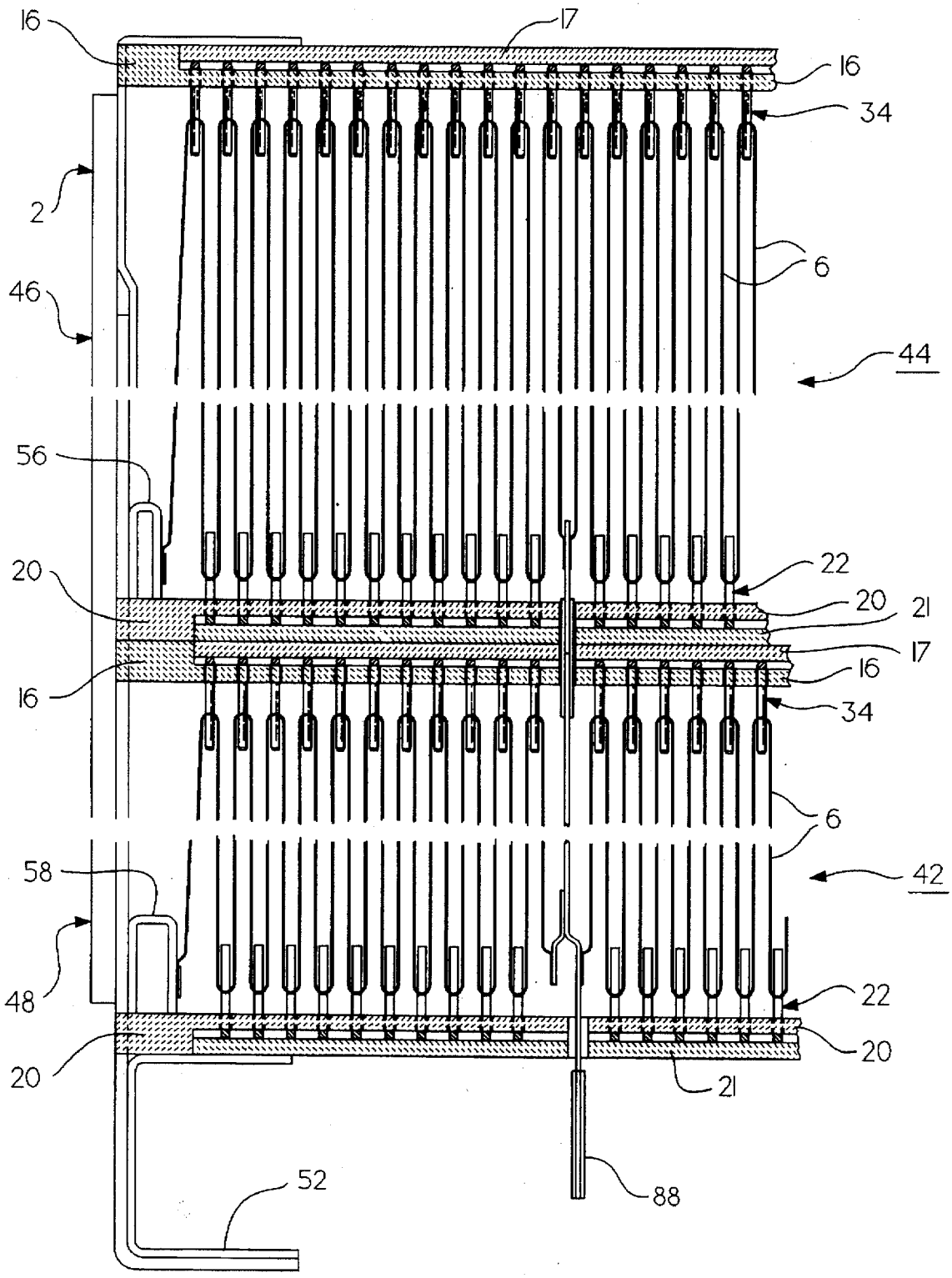
FIG. 8 is a partial fragmentary front elevational view of two continuous weave heat dissipating resistor grids, one above the other mounted in their respective frames, one in a top first tier and the other one in a bottom second tier and showing a tap means connecting the upper and lower tiers in electrical parallel connection.
Figure 15:
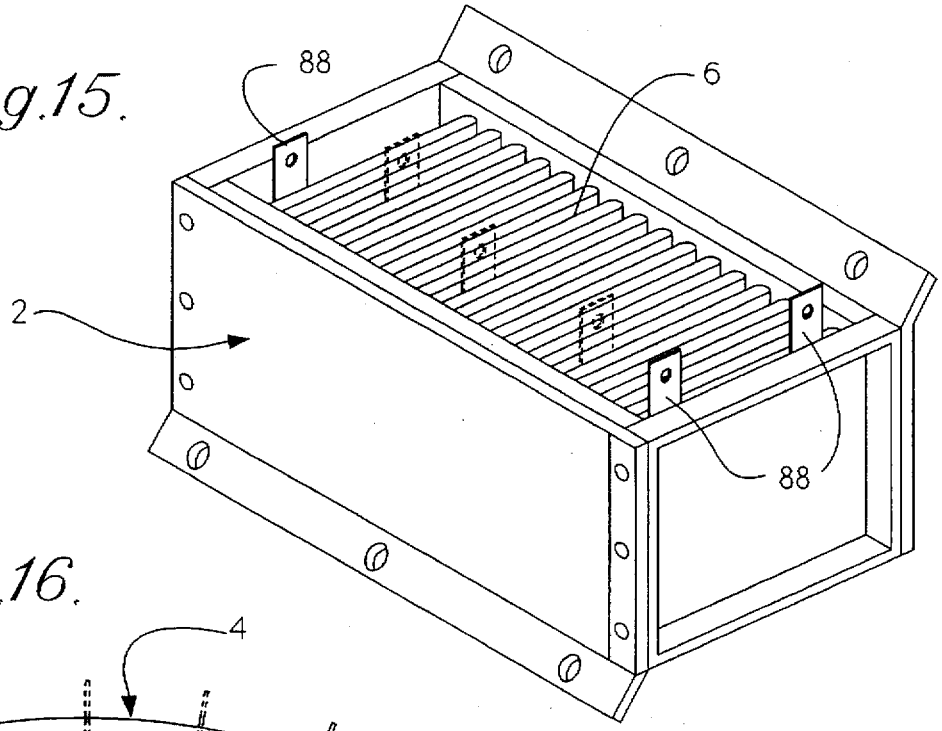
FIG. 15 is a rectangular configuration which can have several levels deep showing electrical taps and alternate taps in chain line.
Figure 16:
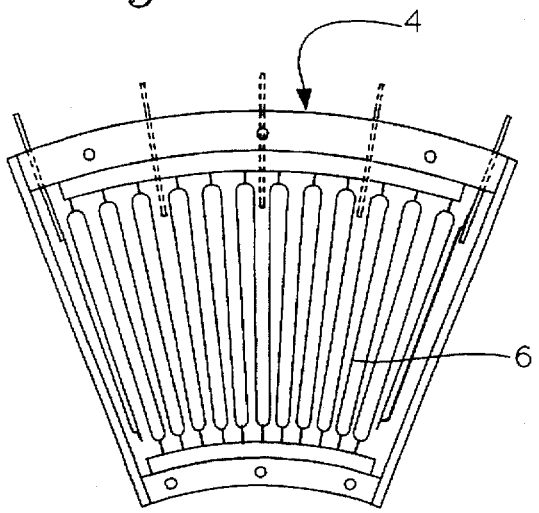
FIG. 16 is an alternate annular configuration of the resistor grid which can have multiple levels.

FIGS. 5, 7, and 8 show resistor grid assemblies which can be placed into a rectangular frame 2 shown in FIG. 15 or into an annular frame 4 shown in FIG. 16. The resistor grid assembly shown in FIGS. 5, 7, and 8 have a continuous weave resistor which comprises a plurality of generally parallel plate-like electrically conductive resistor elements 6 each having two ends 8 and 10. A plurality of U-shaped bends 12 are located in a top group and join two adjacent elements 6 at adjacent ends 8. A plurality of U-shaped bends 14 are located in a bottom group and join two adjacent elements 6 at adjacent ends 10. A top electrical insulating member 16 is adjacent the U-shaped bends 12 in the top group and is spaced a given distance 18 from the U-shaped bends 12 in the top group as shown in FIG. 6.

Figure 3:
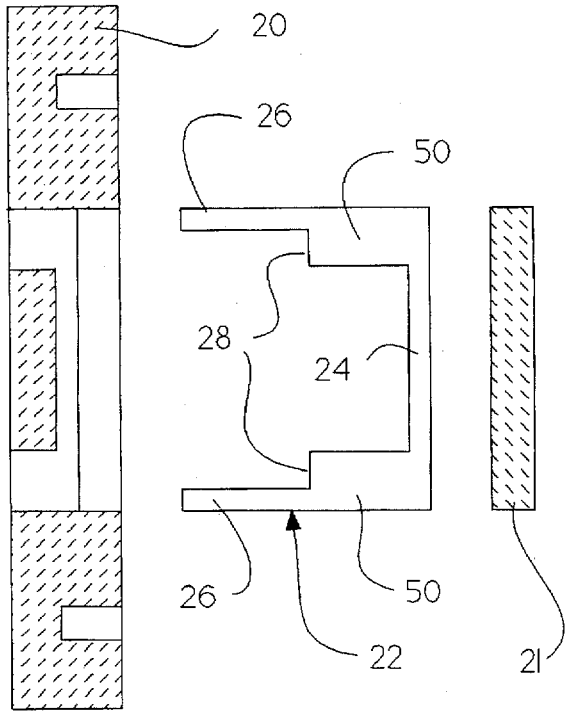
FIG. 3 is a sectional exploded view of a bottom insulating panel with a stop U-shaped pin ready for insertion into the panel The stop U-shaped pin 22 is shown in elevation for clarity.
Figure 4:
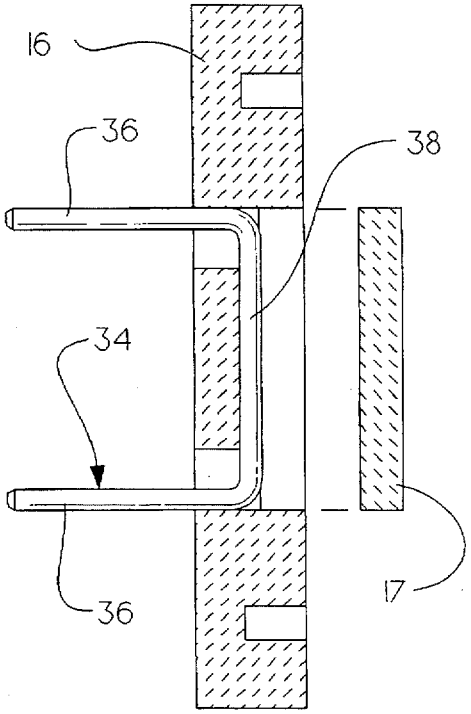
FIG. 4 is a sectional exploded view of a top insulating panel having a wire U-shaped pin The wire U-shaped pin 34 is shown in elevation for clarity.

A plurality of stop U-shaped pins 22 (shown in detail in FIGS. 1, 3 and 6) each have a bottom 24 and two legs 26 and a pair of shoulders 28. The stop U-shaped pins 22 are supported by the bottom electrical insulating member 20 with retainer 21 at the bottom 24 of the stop U-shaped pin 22 and the legs 26 of each stop U-shaped pin 22 extend toward the U-shaped bends 14 (FIGS. 5 and 6) and are inserted into a corresponding pair of holes 30 in the bottom group of the U-shaped bends 14 (FIG. 6). The U-shaped bends 14 in the bottom group rest on the shoulders 28 of the stop U-shaped pin 22. The shoulders 28 are spaced 32 from the bottom electrical insulating member 20. This allows air to circulate and cool the heated resistor elements 6 and the U-shaped bends 14.

A plurality of wire U-shaped pins 34 (FIGS. 2, 4, 5 and 6) are supported by the top electrical insulating member 16 and retainer 17 and each wire U-shaped pin 34 has two legs 36 and bottom 38. The legs 36 extend toward the U-shaped bends 12 in the top group and are inserted into a corresponding pair of holes 40 in the U-shaped bends 12 in the top group. Whenever the resistor elements 6 expand due to heat, the U-shaped bends 12 in the top group move on the legs 36 of the wire U-shaped pin 34 toward the top insulating member 16 and the resistor 6 slides on the legs 36 of the wire U-shaped pin 34.

A second resistor grid assembly 42 substantially similar to the first resistor grid assembly 44 (FIG. 7) is placed below the first resistor grid assembly 44. The first resistor grid assembly 44 was described above and is located in a first tier 46. The second resistor grid assembly 42 is located in a second tier 48 (FIG. 7).

Figure 1:
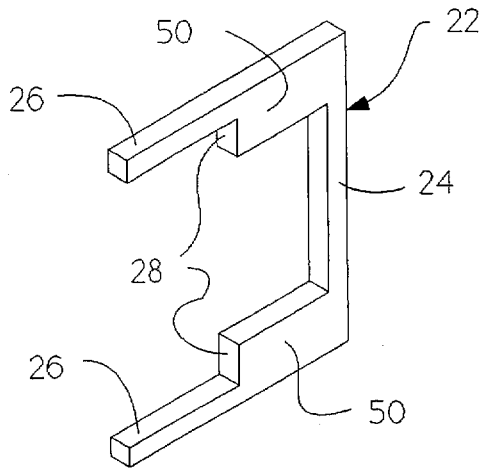
FIG. 1 is an isometric view of a stop U-shaped pin stamping.
Figure 2:
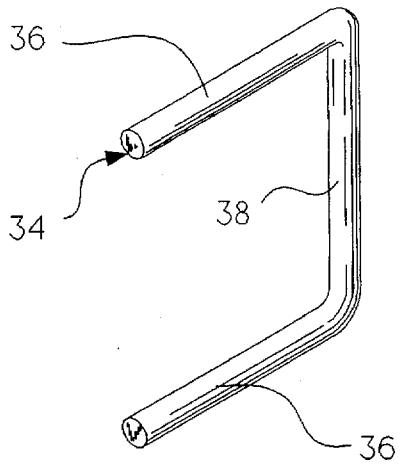
FIG. 2 is an isometric view of a wire U-shaped pin.

The stop U-shaped pins 22 have a bottom 24 which is in a form of a cross member which joins the two legs 26 (FIG. 1). Each of the legs 26 has a thickened surface area 50 which extend toward each other and extend from the bottom 24 partially along each leg 26 and terminates in a flat surface area known as a shoulder 28. The flat surface area (shoulder 28) is parallel to the cross member (bottom 24). The U-shaped bends 14 in the, bottom group rest upon the shoulders 28.

Figure 14:
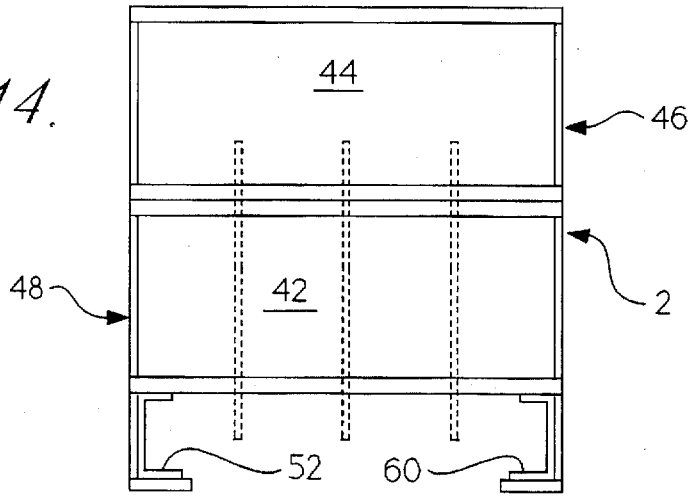
FIG. 14 is a rectangular Frame having a top tier and a bottom tier showing connecting taps in chainline.

FIGS. 14 and 15 show that the resistor grid can be in a rectangular frame 2 and FIG. 14 shows the top tier or first tier 46 with the first resistor grid assembly on top of the bottom tier or second tier 48 with the second resistor grid assembly 42.

Figure 17:
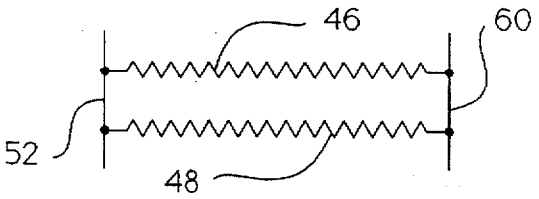
FIG. 17 is a schematic of the electrical connection of the top and bottom resistor grids in parallel.

The first tier 46 and second tier 48 are electrically connected in parallel as shown in FIG. 17. The first tier 46 is represented schematically and the second tier 48 is represented schematically. The input terminal 52 (FIG. 7) has a bar 54 which connects input terminal 52 to the input terminal 56 of the first resistor grid assembly 44 in the first tier 46 and the second grid resistor assembly 42 in second tier 48 to input terminal 58. The output terminal 60 connects output terminal 62 of the second grid resistor assembly 42 in the second tier 48 and the output terminal 64 of the first resistor grid 44 in the first tier 46 by bar 66.

In addition to the resistor grid assembly being rectangular it can also be annular in configuration. The elements 6 and bends can be similarly supported as shown in FIG. 16. The stop U-shaped pins 22 and the wire U-shaped pins 34 are not shown in detail in FIG. 16 but it is understood that the structure would be similar to that shown supporting the U-shaped bends in the other figures showing the rectangular configuration.

The resistor grid can have tap means illustrated in FIG. 14 by chain line to take off different voltages to run such items as cooling fans (not shown). The taps illustrated are shown in FIGS. 8, 9, 10, 11, 12, 13, 14, 15, 16 and 18.

Figure 18:
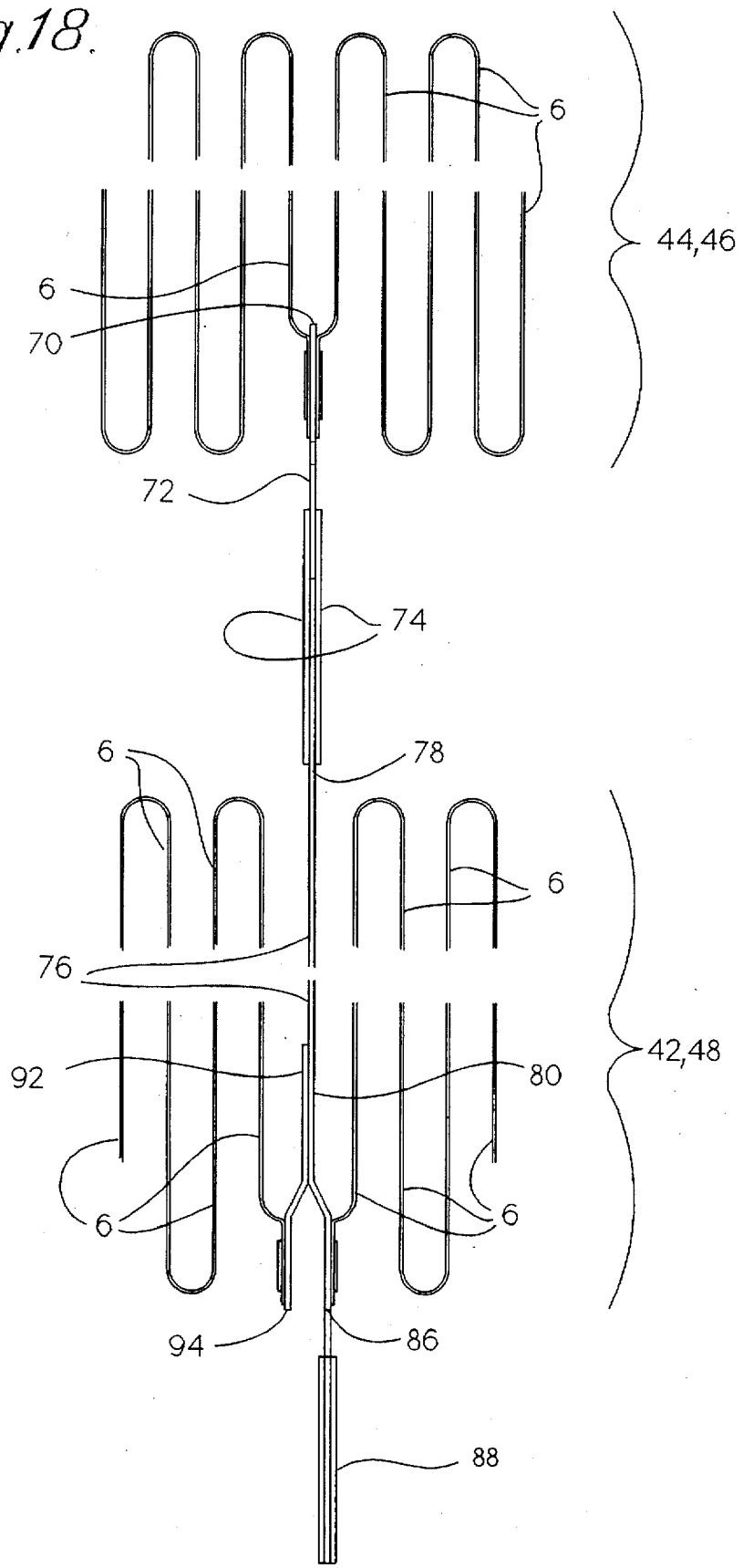
FIG. 18 is an enlarged elevational view of a portion of FIG. 8 of the tap means for clarity.

FIG. 18 is an enlarged portion of FIG. 8 showing the tap means for clarity. Referring to FIG. 18 it shows two adjacent plate-like electrically conductive resistor elements 6 in the first tier 46 whose ends are adjacent the bottom electrical insulating member 20 (FIG. 8). Each end forms a partial U-shaped bend curved toward the adjacent resistor element end and has first flat members 68 (FIG. 9) extending from the partial U-shaped bend toward the bottom insulating member 20. The first flat members 68 are spaced apart and form a first pair of flat members 68. A second flat member 70 is inserted between the first pair of flat members 68 and is joined to the first pair of flat members 68. The second flat member 70 has a tongue 72 which extends from the first pair of flat members 68.

Figure 9:
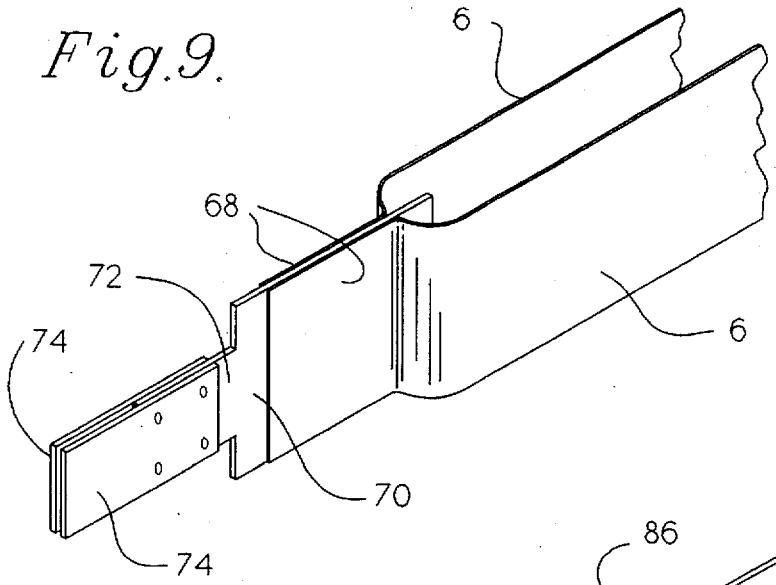
FIG. 9 is an isometric view of the top tap and the electrical conducive resistor element attached to the tap.
Figure 10:
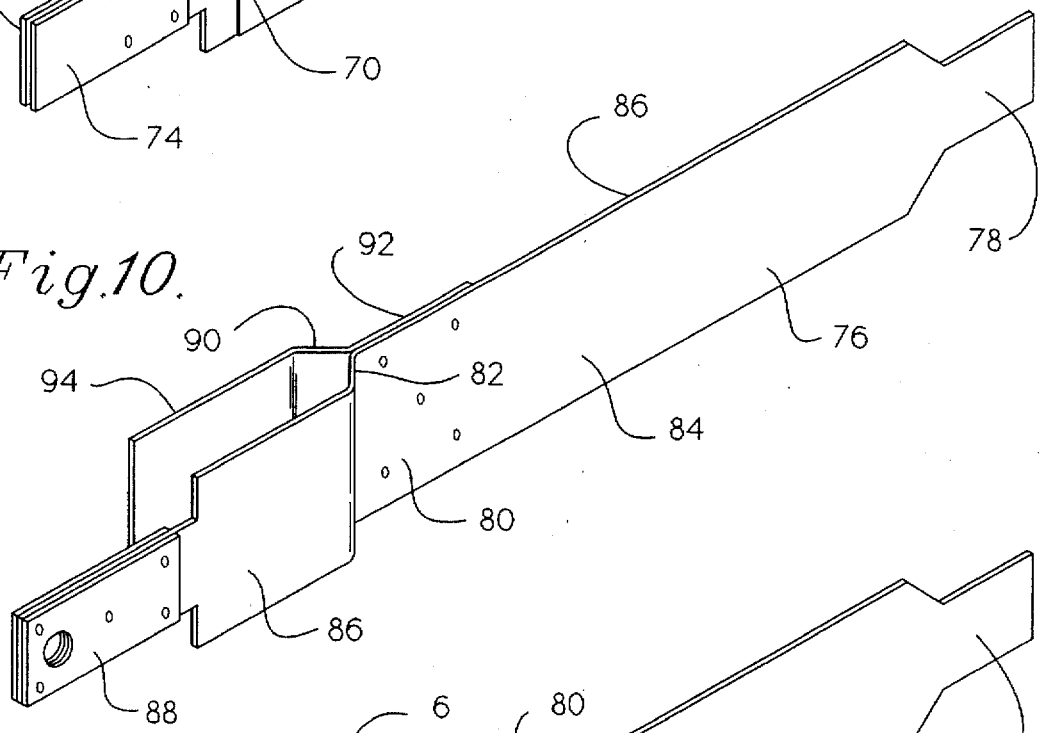
FIG. 10 is an isometric view of the bottom tap.
Figure 11:
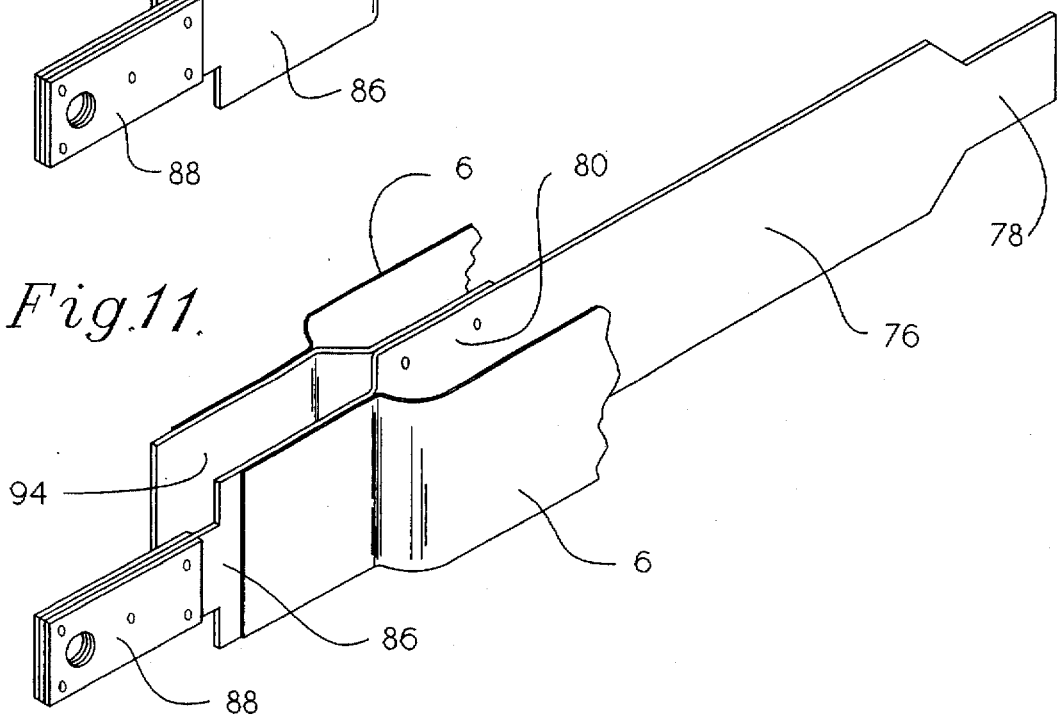
FIG. 11 is an isometric view of the bottom tap connected to electrical conductive resistor elements in the resistor grid in the lower tier.
Figure 12:
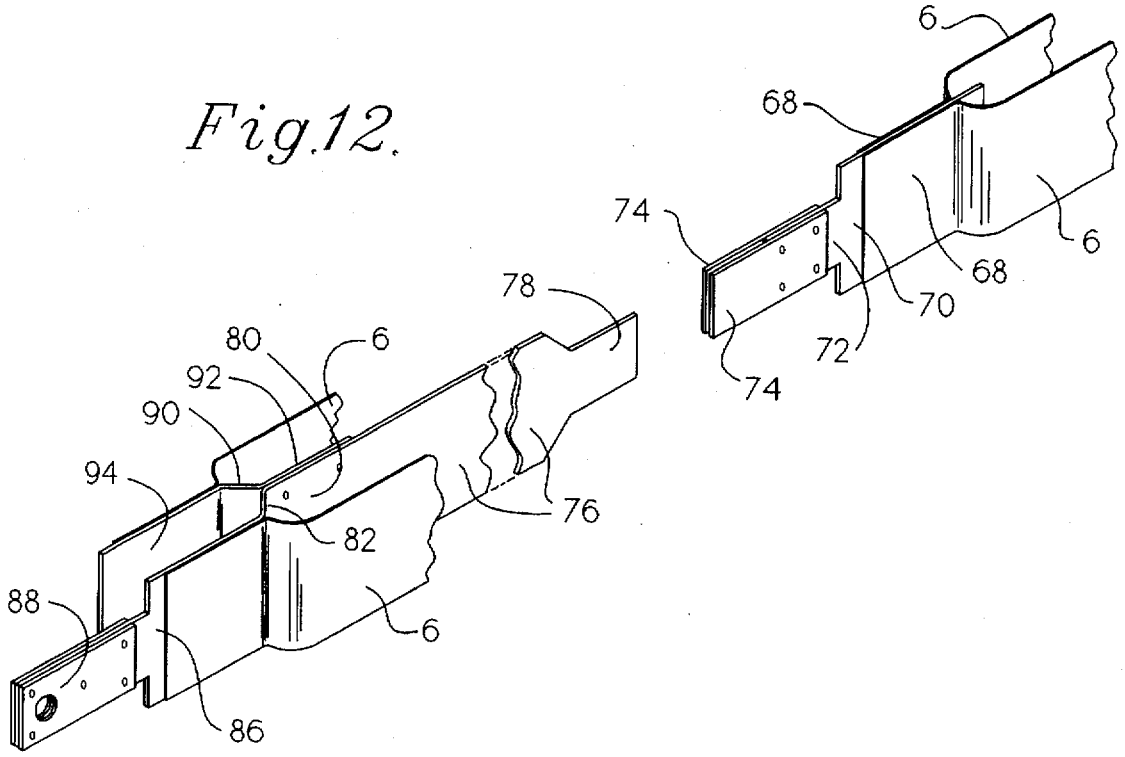
FIG. 12 is an isometric view of FIG. 9 and FIG. 11 aligned to be joined together.
Figure 13:
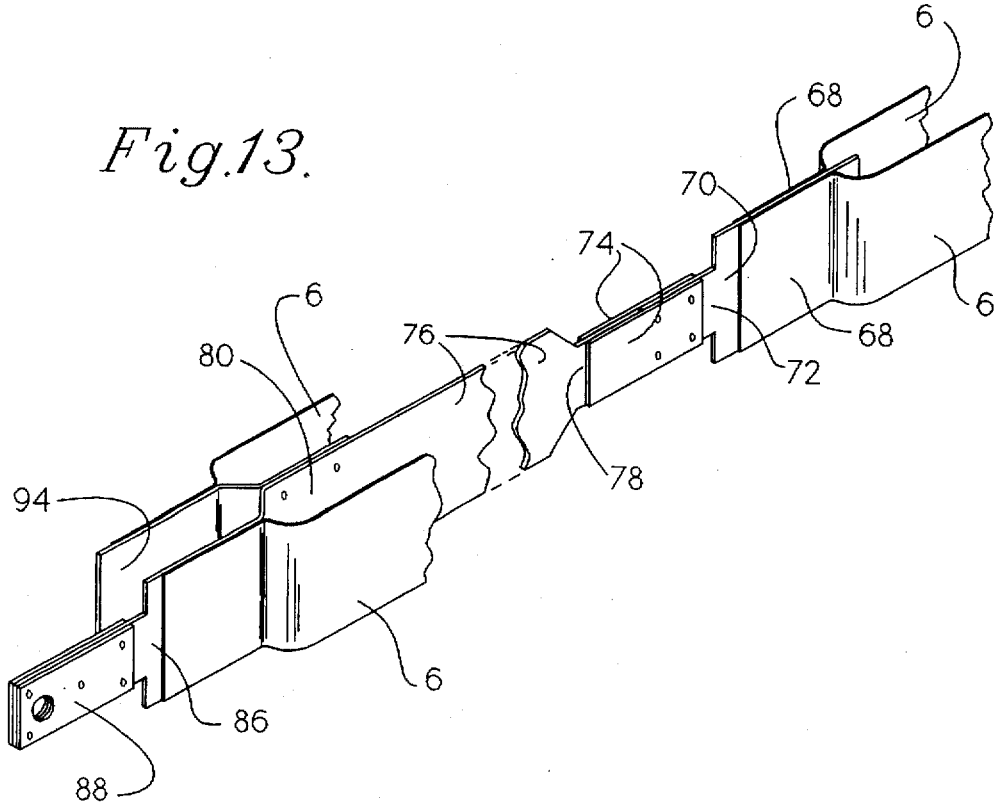
FIG. 13 is an isometric view of FIG. 12 showing the top tap and bottom tap joined.

A second pair of flat members 74 are spaced apart and are joined to the tongue 72 (FIGS. 9, 12 and 13). A third flat member 76 has a second tongue 78 at one end (FIG. 10) which is partially inserted and is joined between the second pair of flat members 74 and extends away from the first tongue 72. The third flat member 76 has a second end 80 opposite the second tongue 78. The second end 80 has a first off-set 82 (FIG. 10) from a first side 84 of the third flat member 76 and has a fourth flat surface 86 parallel to the third flat member 76. The fourth flat surface 86 has a terminal 88 for an electrical connection to run a device such as a fan (not shown) to cool the resistor.

A second off-set 90 from a second side 92 of the third flat member 76 has a fifth flat surface 94 opposite and parallel to the fourth flat surface 86. Two resistor elements 6 (FIG. 11) in the second tier 48 has ends adjacent to bottom insulating member 20 with one end of one resistor element 6 joined to the fourth flat surface 86 of the third flat member 76 and one end of the other adjacent resistor element 6 joined to the fifth flat surface 94.

While we have described presently preferred embodiments of the invention it is to be distinctly understood that the invention is not limited, but may be otherwise embodied and practiced within the scope of the following claims.

We claim:

1. A resistor grid assembly comprising:

a. a continuous resistor weave comprising:

(i) a plurality of generally parallel, plate-like electrically conductive resistor elements each having two ends; and (ii) a plurality of U-shaped bends each with a pair of holes, one U-shaped bend joining two adjacent elements at adjacent ends, the U-shaped bends being located in a bottom group and a top group;

b. a top electrical insulating member adjacent the U-shaped bends in the top group and spaced a given distant from the U-shaped bends in the top group;

c. a bottom electrical insulating member adjacent the U-shaped bends in the bottom group;

d. a plurality of stop U-shaped pins each having a bottom and two legs and a shoulders one each leg and supported by the bottom electrical insulating member at the bottom of the slop U-shaped pin, the legs of each stop U-shaped pin extending toward the U-shaped bends and inserted into a corresponding pair of holes in the bottom group, the shoulders spaced from the bottom electrical insulating member, the U-shaped bends in the bottom group resting on the shoulders of the stop U-shaped pins whereby the shoulders prevent the U-shaped bends in the bottom group from touch the bottom insulating member; and e. a plurality of U-shaped pins supported by the top electrical insulating member and each U-shaped pin having two legs and a bottom in which the legs extend toward the U-shaped bends and are inserted into a corresponding pair of holes in the U-shaped bends in the top group, whereby whenever the resistor elements expand due to heat, the U-shaped bends in the top group move on the legs of the U-shaped pin toward the top insulating member whereby when the resistor heats, expansion is controlled in a direction toward the top insulating member and the resistor slides on the U-shaped pin.

2. A resistor grid assembly as recited in claim 1 including:

a second grid resistor assembly substantially similar to the grid resistor assembly, the grid resistor assembly in a first tier and the second grid resistor assembly in a second tier, the first and second tier assemblies being connected in electrical parallel.

3. A resistor grid assembly as recited in claim 1 wherein the stop U-shaped pins have the two legs spaced apart and joined by a cross member and each of the legs having an integral thickened surface area extending toward each other and extending from the cross member partially along each leg and terminating in a flat surface area parallel to the cross member, the flat surface area adjacent each leg forming the shoulders upon which the U-shaped bends rest, the cross member supported within the bottom electrical insulating member and the legs extend away from the bottom electrical insulating member to receive the U-shaped bends.

4. A resistor grid assembly as recited in claim 1 wherein the U-shaped pin has the legs joined by a cross member which is supported within the top electrical insulating member and the legs extend away from the cross member and from the top electrical insulating member to receive the U-shaped bends.

5. A resistor grid assembly as recited in claim 1 wherein the grid is in a rectangular configuration.

6. A resistor grid assembly as recited in claim 1 wherein the grid is in an annular configuration.

7. A resistor grid assembly as recited in claim 2 including a tap means connecting the first and second tier, the tap means positioned at some point between ends of the continuous resistor weave in each of the first and second tiers and extending through the adjacent insulating members of the first and second tiers.

8. A resistor grid assembly comprising:

a. a continuous resistor weave comprising:

(i) a plurality of generally parallel, plate-like electrically conductive resistor elements each having two ends; and (ii) a plurality of U-shaped bends each with a pair of holes, one U-shaped bend joining two adjacent elements at adjacent ends, the U-shape bends being located in a bottom group and a top group;

b. a top electrical insulating member adjacent the U-shaped bends in the top group and spaced a given distance from the U-shaped bends in the top group;

c. a bottom electrical insulating member adjacent the U-shaped bends in the bottom group;

d. a plurality of stop U-shaped pins each having a bottom and two legs and a pair of shoulders and supported by the bottom electrical insulating member at the bottom of the stop U-shaped pin, the legs of each stop U-shaped pin extending toward the U-shaped bends and inserted into a corresponding pair of holes in the bottom group, the shoulders spaced from the bottom electrical insulating member, the U-shaped bends in the bottom group resting on the shoulders of the stop U-shaped pins;

e. a plurality of U-shaped pins supported by the top electrical insulating member and each U-shaped pin having two legs and a bottom in which the legs extend toward the U-shaped bends and are inserted into a corresponding pair of holes in the U-shaped bends in the top group, whereby whenever the resistor elements expand due to heat, the U-shaped bends in the top group move on the legs of the U-shaped pin toward the top insulating member whereby when the resistor heats, expansion is controlled in a direction toward the top insulating member and the resistor slides on the U-shaped pin;

f. a second grid resistor assembly substantially similar to the grid resistor assembly, the grid resistor assembly in a first tier and the second grid resistor assembly in a second tier, the first and second tier assemblies being connected in electrical parallel; and g. a tap means connecting the first and second tier, the tap means positioned at some point between ends of the continuous resistor weave in each of the first and second tiers and extending through the adjacent insulating members of the first and second tiers, the tap means comprises:

a. two adjacent plate-like electrically conductive resistor elements in the first tier whose ends are adjacent to the bottom electrical insulating member, each end forming a partial U-shaped bend curved toward the adjacent resistor element end and having a first flat member extending from the partial U-shaped bend toward the bottom insulating member, the flat members of each adjacent resistor end spaced apart forming a first pair of flat members;

b. a second flat member inserted between the first pair of flat members and joined to the first pair of flat members, the second flat member having a first tongue extending from the first pair of flat members;

c. a second pair of flat members spaced apart and joined to the first tongue forming a partial sandwich with the first tongue partially inserted and joined between the second pair of flat members;

d. a third flat member having a second tongue at one end which is partially inserted and joined between the second pair of flat members and extending away from the first tongue, the third flat member having a second end opposite the second tongue, the second end having a first off-set from a first side of the third flat member and having a fourth flat surface parallel to the third flat member and having a terminal for electrical connection at an end remote from the off-set;

e. a second off-set from a second side of the third flat member and having a fifth flat surface opposite and parallel to the fourth flat surface; and f. two adjacent resistor elements in the second tier having ends adjacent the bottom insulating member with one end of one resistor element joined to the fourth flat surface of the third flat member and one end of the other adjacent resistor element joined to the fifth flat surface.

* * * * *

UNITED STATES PATENT AND TRADEMARK OFFICE

CERTIFICATE OF CORRECTION

PATENT NO. : 5,686,880

DATED : November 11, 1997

INVENTOR(S) : Robert Cummins, Victor V. Kirilloff, and William A. Benson

It is certified that error appears in the above-identified patent and that said Letters Patent is hereby corrected as shown below:

Column 3, line 15, delete "conducive" insert --conductive--.

Column 4, line 25, after "the" delete ",".

Column 5, line 39, delete "distant" insert --distance--.

Column 5, line 43, delete "shoulders one" insert --shoulder on--.

Column 5, line 45, delete "slop" insert --stop--.

Column 5, line 52, delete "touch" insert --touching--.

Signed and Sealed this

Third Day of February, 1998

*Attest:*

Bruce Lehman

BRUCE LEHMAN

*Attesting Officer*

*Commissioner of Patents and Trademarks*